US007633467B2

(12) United States Patent
Cho et al.

(10) Patent No.: US 7,633,467 B2
(45) Date of Patent: Dec. 15, 2009

(54) PLASMA DISPLAY APPARATUS AND DRIVING METHOD THEREOF

(75) Inventors: Janghwan Cho, Uiwang-si (KR); Donghyuk Park, Gyeongsongbuk do (KR); Changyoung Kwon, Pohong si (KR); Dong Kwon Choi, Ulean (KR); Yang Ki An, Gyeongsangbuk do (KR); Jinyoung Kim, Daegu (KR); Yunkwon Jung, Gyeongsangbuk-do (KR)

(73) Assignee: LG Electronics Inc., Seoul (KR)

( * ) Notice: Subject to any disclaimer, the term of this patent is extended or adjusted under 35 U.S.C. 154(b) by 649 days.

(21) Appl. No.: 11/283,906

(22) Filed: Nov. 22, 2005

(65) Prior Publication Data

US 2006/0109214 A1 May 25, 2006

(30) Foreign Application Priority Data

Nov. 24, 2004 (KR) ..... 10-2004-0096977
May 21, 2005 (KR) ..... 10-2005-0042758

(51) Int. Cl.
*G09G 3/28* (2006.01)

(52) U.S. Cl. ..... 345/60; 315/169.4

(58) Field of Classification Search ..... 345/60
See application file for complete search history.

(56) References Cited

U.S. PATENT DOCUMENTS 5,155,674 A * 10/1992 Tanoue et al. ..... 363/58
5,576,738 A * 11/1996 Anwyl et al. ..... 345/212
6,633,285 B1 10/2003 Kigo et al.
6,710,550 B2 * 3/2004 Bang ..... 315/169.4
2001/0012005 A1 * 8/2001 Choi ..... 345/211
2003/0137254 A1 7/2003 Bang
2004/0212564 A1 * 10/2004 Lee et al. ..... 345/60

FOREIGN PATENT DOCUMENTS

CN 1337036 A 2/2002
JP 11316572 A 11/1999
KR 2002-0075627 * 10/2002
KR 2002075627 10/2002
KR 2002075627 A * 10/2002
KR 2003025543 A * 3/2003
KR 2003-0025543 * 6/2004
KR 2005-0037639 * 4/2005
KR 2005037639 A * 4/2005

OTHER PUBLICATIONS

Moghimi, Reza, Curing Comparator Instability with Hysteresis, 2000, Analog Dialogue 34-7.*

* cited by examiner

*Primary Examiner*—Richard Hjerpe
*Assistant Examiner*—Dorothy Webb
(74) *Attorney, Agent, or Firm*—Birch, Stewart, Kolasch & Birch, LLP

(57) ABSTRACT

A plasma display apparatus and a driving method thereof are disclosed. The plasma display apparatus comprises a plasma display panel in which a plurality of electrodes are formed, an energy storage unit for storing energy applied to the electrodes, and a protector for maintaining a voltage level of the energy stored in the energy storage unit at a predetermined voltage range.

22 Claims, 7 Drawing Sheets

PLASMA DISPLAY APPARATUS AND DRIVING METHOD THEREOF

CROSS-REFERENCES TO RELATED APPLICATIONS

This Nonprovisional application claims priority under 35 U.S.C. § 119(a) on Patent Application Nos. 10-2004-0096977 and 10-2005-0042758 filed in Korea on Nov. 24, 2004 and May 21, 2005 the entire contents of which are hereby incorporated by reference.

BACKGROUND OF THE INVENTION

1. Field of the Invention

The present invention relates to a plasma display apparatus and a driving method thereof 2. Background of the Related Art Generally, a plasma display apparatus comprises a plasma display panel in which barrier ribs formed between a front panel and a rear panel constitute a single unit cell. Each cell is filled with a main discharge gas, such as neon (Ne), helium (He) or a mixed gas (Ne+He) of Ne and He, and an inert gas comprising a small amount of xenon Xe. When those gases are discharged by a high frequency voltage, the inert gas generates vacuum ultraviolet rays and radiates a phosphor material formed between the barrier ribs, thereby achieving an image.

FIG. 1 is a view illustrating a structure of a general plasma display panel.

In the plasma display panel shown in FIG. 1, a front panel 100 in which a plurality of sustain electrode pairs consisting in pairs of scan electrodes 102 and sustain electrodes 103 in pairs is disposed on a front substrate 110 for displaying an image and a rear panel 110 in which a plurality of address electrodes 113 intersecting the plurality of sustain electrode pairs is disposed on a rear substrate 111 are coupled in parallel at regular intervals to each other.

The front panel 100 comprises the scan and sustain electrodes 102 and 103 formed in pairs to discharge each other in one discharge cell and to keep the radiation of the cell. Each of the scan and sustain electrodes 102 and 103 is comprised of a transparent electrode 'a' made of an ITO (Indium-Tin-Oxide) material and a bus electrode 'b' made of metal. The scan and sustain electrodes 102 and 103 are covered with one or more dielectric layers 104 for limiting discharge current and insulating the electrode pairs from each other. A protective layer 105 deposited by magnesium oxide (MgO) is formed on the dielectric layers 104 to facilitate a discharge condition.

Barrier ribs 112 in a stripe or well shape are disposed in parallel in the rear panel 110 to form a plurality of discharge spaces, that is, discharge cells. One or more address electrodes 113 are disposed parallel to the barrier ribs 112 to cause an inert gas within the discharge cell to generate vacuum ultraviolet rays by performing an address discharge. An RGB phosphor 114 for emitting visual rays to display an image during a sustain discharge is coated on the upper surface of the rear panel 110. A dielectric layer 115 for protecting the address electrodes 113 is formed between the address electrodes 113 and the phosphor 114.

A plasma display apparatus for driving the above-described plasma display panel, a plurality of discharge cells is formed in a matrix type and drivers (not shown) having a driving circuit for supplying given pulses to the discharge cells are mounted.

In more detail, the plasma display apparatus comprises a controller for generating a control signal for controlling the plasma display panel upon receipt of an external image signal, a data driver for supplying a pulse to the address electrode by the control signal generated from the controller, a scan driver for supplying a pulse to the scan electrodes, and a sustain driver for supplying a sustain pulse to the sustain electrodes.

On the other hand, upon occurrence of charge and discharge in the plasma display panel, a driving pulse for driving the plasma display apparatus is generated by a switching operation of the respective drivers. As a result, an energy loss of the plasma display apparatus is increased and the temperature of a switching device is raised. Accordingly, the conventional plasma display apparatus comprises an energy recovering circuit for recycling an energy supplied to the plasma display panel, as illustrated in FIG. 2.

FIG. 2 is a view illustrating a conventional energy recovery circuit of the plasma display apparatus.

As shown in FIG. 2, the energy recovery circuit comprises a capacitive load Cp which acts as a load of the plasma display panel, an energy storage unit, i.e., a capacitor Cs for accumulating the energy recovered from the capacitive load Cp, an inductor L connected between the capacitor Cs and a scan or sustain driver 210 for applying a sustain voltage Vs, and first and second switches $S_1$ and $S_2$ connected in parallel between the capacitor Cs and the inductor L. Here, the sustain driver 210 is comprised of third and fourth switches $S_3$ and $S_4$ connected in parallel between the capacitive load Cp and the inductor L.

The operation of recovering and re-using energy of the above plasma display apparatus is as follows.

When the first switch $S_1$ is turned on, a voltage Vs/2 stored previously in the capacitor Cs is supplied to the capacitive load Cp via the inductor L. At this time, a resonance circuit is formed by the inductor L, and thus a voltage Vs, approximately twice the voltage stored previously in the source capacitor Cs, is applied to the capacitive load Cp.

With the first switch $S_1$ being turned on, when the third switch S3 is turned on, the sustain voltage Vs is applied to the capacitive load Cp, and the capacitive load Cp maintains the sustain voltage Vs during the turn-on of the third switch $S_3$.

When the second switch $S_2$ is turned on simultaneously with the turn-off of the first switch S1 and third switch $S_3$, a current path extending from the capacitive load Cp to the capacitor Cs via the second switch $S_2$ is formed, and thus the energy accumulated in the capacitive load Cp is recovered to the capacitor Cs, thereby accumulating a voltage Vs/2, approximately half the sustain voltage Vs, in the capacitor Cs.

When the fourth switch $S_4$ is turned on as the second switch $S_2$ is turned off, the capacitive load Cp continues to discharge until it reaches the ground voltage level GND.

Meanwhile, when the energy is recovered to the capacitor Cs, a malfunction or short-circuit may occur in the second switch S2. At this time, a voltage continues to be applied to the capacitor Cs through the second switch $S_2$, and thus an excessive energy is accumulated in the capacitor Cs, thereby overheating and destroying the capacitor Cs. Further, the stability of the circuit deteriorates due to damage to the capacitor Cs.

Moreover, in the event of a short-circuit in the capacitor Cs, the energy cannot be accumulated in the capacitor Cs, thereby increasing power consumption in the plasma display apparatus.

SUMMARY OF THE INVENTION

Accordingly, the present invention has been made in view of the above problems occurring in the prior art, and it is an object of the present invention to provide a plasma display apparatus which is capable of preventing an excessive voltage from being accumulated in an energy storage unit, that is, in a capacitor, and a driving method thereof.

It is another object of the present invention to provide a plasma display apparatus which is capable of improving stability of a circuit by suppressing heat and damage of a device, and a driving method thereof.

It is still another object of the present invention to provide a plasma display apparatus which is capable of reducing power consumption, and a driving method thereof.

To achieve the above objects, according to the present invention, there is provided a plasma display apparatus, comprising: a plasma display panel in which a plurality of electrodes are formed; an energy storage unit for storing energy applied to the electrodes; and a protector for maintaining a voltage level of the energy stored in the energy storage unit at a predetermined voltage range.

There is also provided a plasma display apparatus, comprising: a plasma display panel in which a plurality of electrodes are formed; a capacitor for storing energy supplied to the electrodes; and a comparator connected to the capacitor, for comparing a voltage level of the capacitor with a predetermined voltage range. At least one driving switching device connected to the capacitor is turned off according to the result of comparison of the comparator.

There is also provided a method of driving a plasma display apparatus comprising a plurality of electrodes, comprising the steps of: determining whether an energy in a capacitor for storing energy supplied to the electrodes is maintained at a predetermined voltage range; and stopping an operation for driving the plurality of electrodes if the energy is outside of the predetermined voltage range.

The plasma display apparatus of the invention can suppress an overvoltage charged in an energy storage unit, i.e., a capacitor.

The plasma display apparatus of the invention can improve stability of a circuit by suppressing heat and damage of a device.

The plasma display apparatus of the invention can reduce power consumption.

BRIEF DESCRIPTION OF THE DRAWINGS

Further objects and advantages of the invention can be more fully understood from the following detailed description taken in conjunction with the accompanying drawings in which.

DETAILED DESCRIPTION OF THE PREFERRED EMBODIMENT

Figure 1:
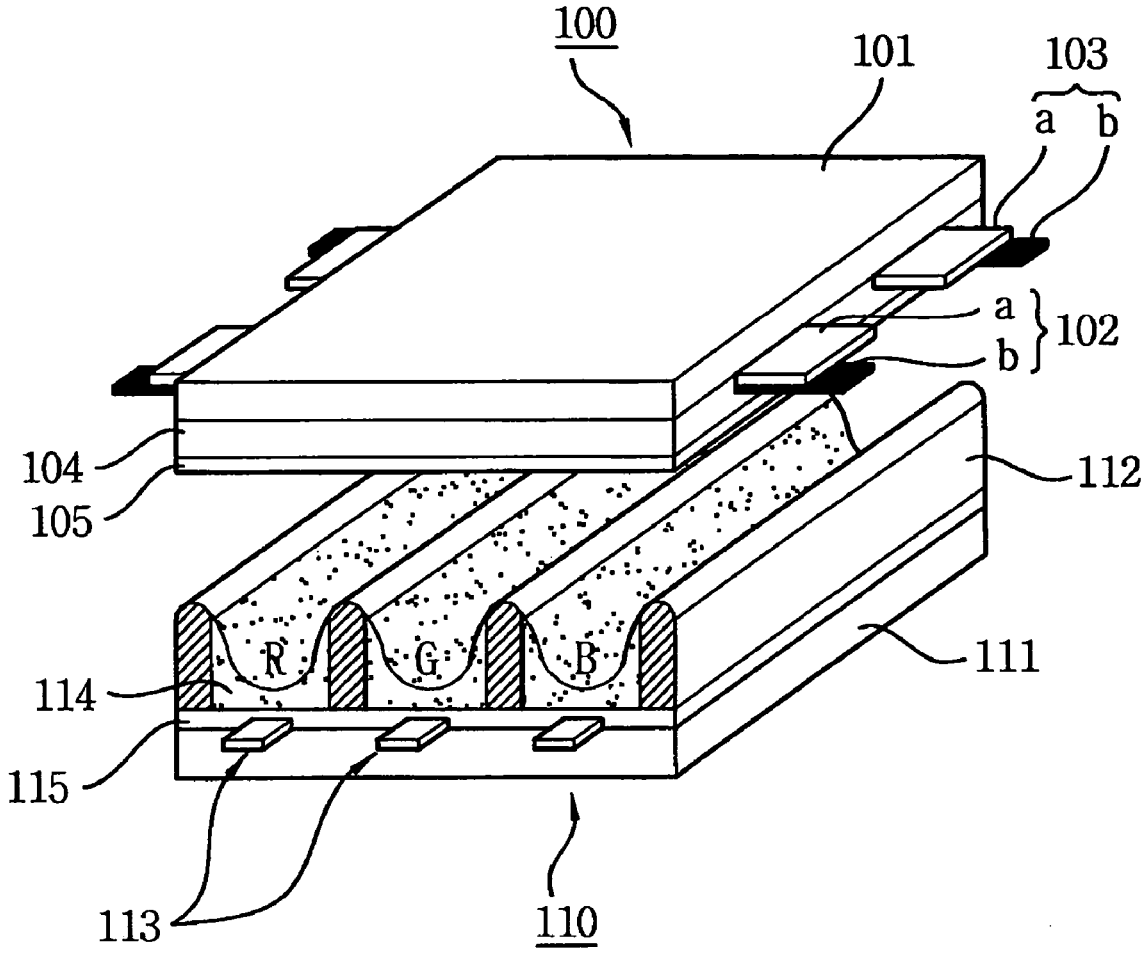
FIG. 1 is a view illustrating a structure of a conventional plasma display panel.
Figure 2:
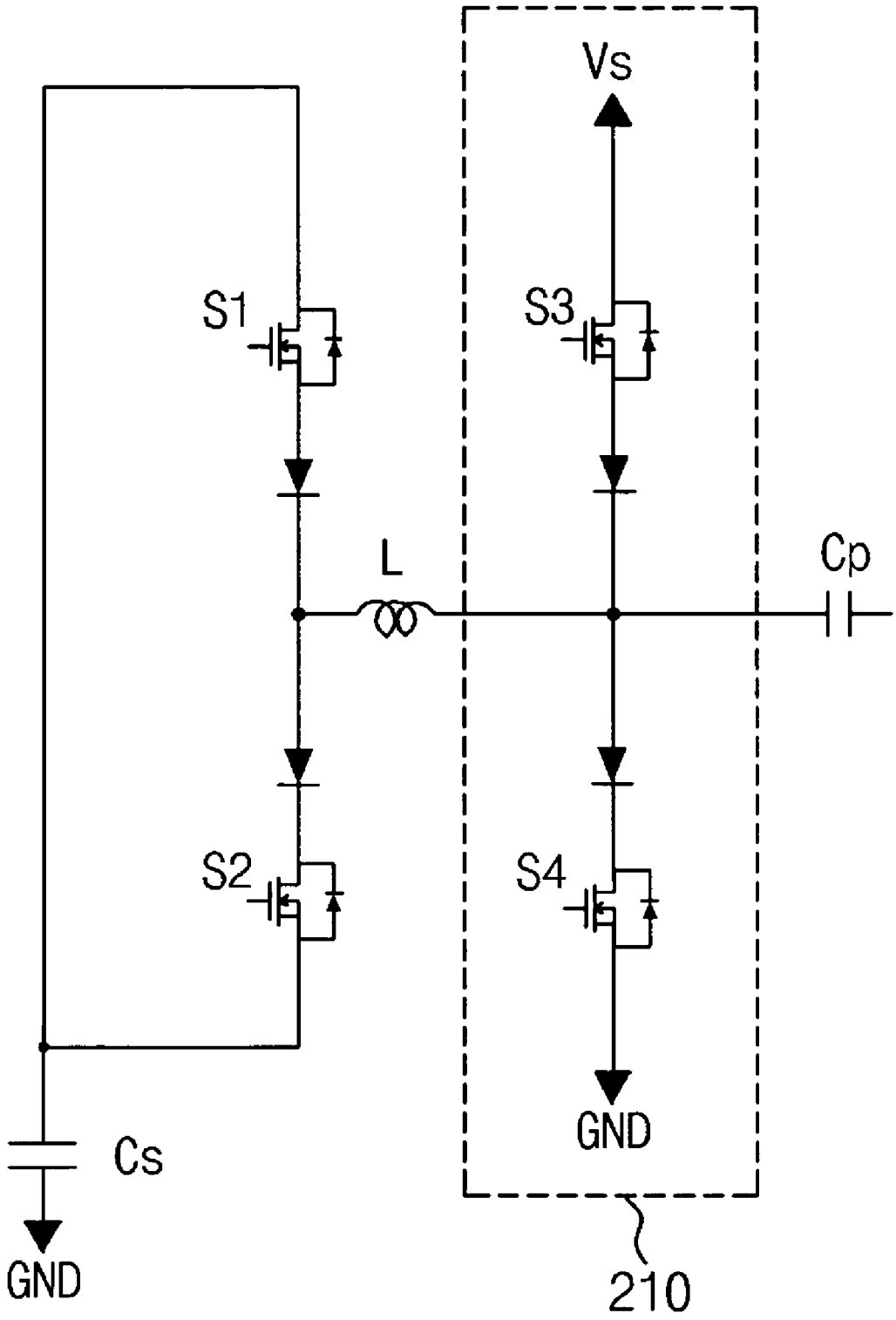
FIG. 2 is a view illustrating an energy recovery unit of a conventional plasma display apparatus.

The present invention will now be described in detail in connection with preferred embodiments with reference to the accompanying drawings.

According to an aspect of the present invention, a plasma display apparatus comprising: a plasma display panel in which a plurality of electrodes are formed; an energy storage unit for storing energy applied to the electrodes; and a protector for maintaining a voltage level of the energy stored in the energy storage unit at a predetermined voltage range.

The predetermined voltage range is 95% to 105% of a predetermined reference voltage level.

The reference voltage level is substantially half a sustain voltage. The reference voltage level is substantially half an address voltage.

The predetermined voltage range is 20% to 80% of a storage capacitance of the energy storage unit.

The protector comprises a determiner for determining whether the voltage level of the energy is outside of the predetermined voltage range, and blocks an operation of a driver for supplying or recovering the energy from the energy storage unit according to the result of determination of the determiner.

The determiner comprises at least one comparator for comparing the voltage level of the energy with the predetermined voltage range.

The determiner further comprises a compensator for previously compensating a noise component of the energy applied to the comparator. The energy storage unit stores energy for driving a scan electrode or sustain electrode among the plurality of electrodes.

The energy storage unit stores energy for driving an address electrode among the plurality of electrodes.

According to another aspect of the invention, a plasma display apparatus comprises: a plasma display panel in which a plurality of electrodes are formed; a capacitor for storing energy supplied to the electrodes; and a comparator connected to the capacitor, for comparing a voltage level of the capacitor with a predetermined voltage range. At least one driving switching device connected to the capacitor is turned off according to the result of comparison of the comparator.

The comparator comprises a first operational amplifier for comparing the voltage level with a highest value of the predetermined voltage range; and a second operational amplifier for comparing the voltage level with a lowest value of the predetermined voltage range.

The first or second operational amplifier is connected to a feedback resistor.

The first or second operational amplifier is connected to a voltage drop resistor for decreasing an input voltage. The predetermined voltage range is 20% to 80% of an internal pressure of the capacitor.

The capacitor applies a sustain voltage to a scan electrode or sustain electrode among the plurality of electrodes.

The capacitor applies an address voltage to an address electrode among the plurality of electrodes.

According to a further aspect of the present invention, a method of driving a plasma display apparatus comprising a plurality of electrodes, comprises the steps of: determining whether an energy in a capacitor for storing energy supplied to the electrodes is maintained at a predetermined voltage range; and stopping an operation for driving the plurality of electrodes if the energy is outside of the predetermined voltage range.

The capacitor applies a sustain voltage to a scan electrode or sustain electrode among the plurality of electrodes.

The capacitor applies an address voltage to an address electrode among the plurality of electrodes.

Hereinafter, an embodiment of the present invention will now be described with reference to the accompanying drawings.

Figure 3:
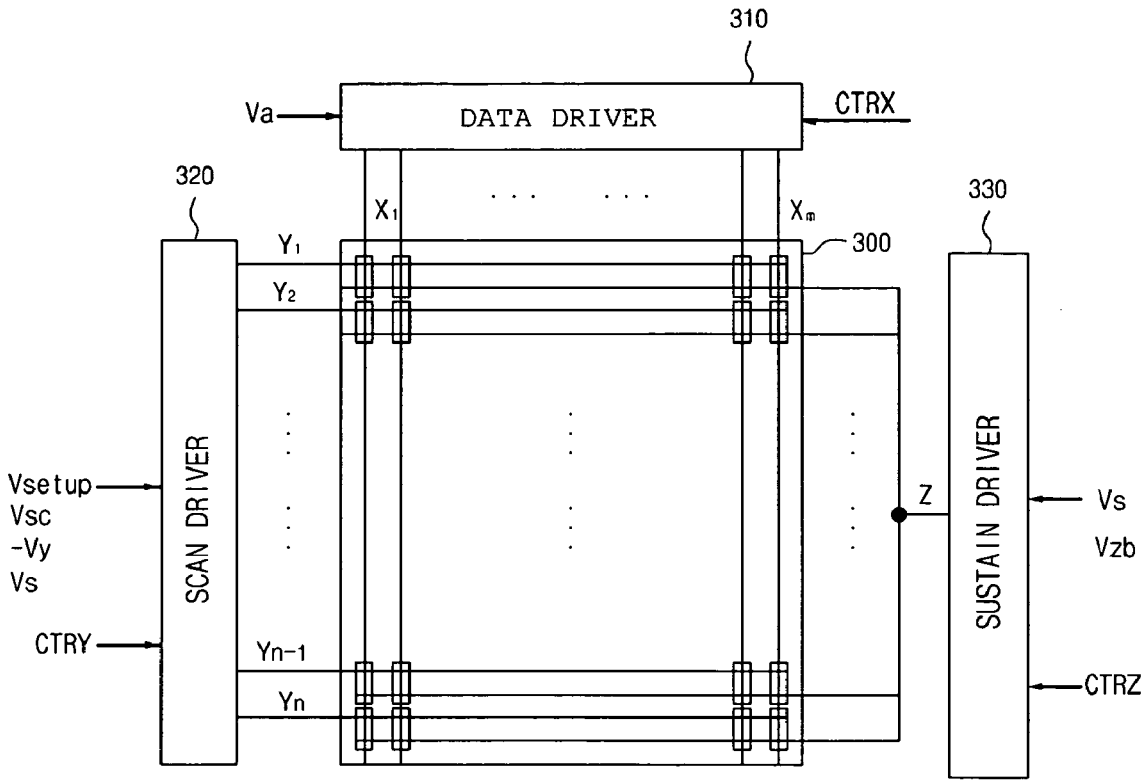
FIG. 3 is a view illustrating a plasma display apparatus according to an embodiment of the present invention.

FIG. 3 is a view illustrating a plasma display apparatus according to an embodiment of the present invention.

As shown in FIG. 3, the plasma display apparatus of the invention comprises a plasma display panel 300, a data driver 310, a scan driver 320, and a sustain driver 330.

The plasma display panel 300 comprises a front panel (not shown) and a rear substrate (not shown) which are assembled together. Scan electrodes $Y_1$ to Yn and sustain electrodes Z are formed on the front substrate, and address electrodes $X_1$ to Xm which intersect the scan electrodes $Y_1$ to Yn and the sustain electrodes Z are formed on the rear substrate.

The data driver 310 applies data to the address electrodes $X_1$ to Xm formed in the plasma display panel 300. In this case, the data means image signal data processed from an image signal processor (not shown) for processing an image signal input from the exterior. The data driver 310 samples and latches data in response to a data timing control signal CTRX generated from a timing controller (not shown) and applies an address waveform having an address voltage Va to the address electrodes $X_1$ to Xm. The data driver 310according to the embodiment of the invention comprises a protector for maintaining the address voltage Va applied to the, address electrodes $X_1$ to Xm, that is, a voltage level of energy stored in an energy storage unit at a given range.

The scan driver 320 drives the scan electrodes $Y_1$ to Yn formed in the plasma display panel 300. The scan driver 320 applies a setup waveform constituting a ramp-up waveform to the scan electrodes $Y_1$ to Yn by a combination of the sustain voltage Vs and a setup voltage Vsetup during a setup period of a reset period, in response to a scan timing control signal CTRY generated from the timing controller (not shown). During a next setdown period of the reset period, the scan driver 320 applies a setdown waveform constituting a ramp-down waveform to the scan electrodes $Y_1$ to Yn. During an address period, the scan driver 320 sequentially supplies the scan electrodes $Y_1$ to Yn with a scan waveform ranging from a scan reference voltage Vsc to a scan voltage −Vy. During a sustain period, the scan driver 320 supplies the scan electrodes $Y_1$ to Yn with at least one sustain waveform for a display discharge ranging from a ground voltage level GND to a sustain voltage Vs.

The scan driver 320 according to the embodiment of the present invention comprises a protector for maintaining the sustain voltage Vs applied to the scan electrodes $Y_1$ to Yn, that is, a voltage level of energy stored in an energy storage unit at a given range.

The sustain driver 330 drives the sustain electrodes Z forming a common electrode in the plasma display panel 300. During the address period, the sustain driver 330 applies a waveform with a positive bias voltage Vzb to the sustain electrodes Z in response to a scan timing control signal CTRZ generated from the timing controller (not shown). During the sustain period, the sustain driver 330 supplies the sustain electrodes Z with at least one sustain waveform for a display discharge ranging from the ground voltage level GND to the sustain voltage Vs.

The sustain driver 330 according to the embodiment of the present invention comprises a protector for maintaining the sustain voltage Vs applied to the sustain electrodes Z, that is, a voltage level of energy stored in an energy storage unit at a given range.

As described above, the plasma display apparatus of the invention comprises an energy storage unit for storing the energy supplied to at least one of the address electrodes, scan electrodes and sustain electrodes, and also comprises a protector for preventing a voltage level of energy stored in the energy storage unit from deviating from a given range.

The energy storage unit and protector may be contained in any one of the respective drivers 310, 320 and 330. Moreover, the energy storage unit and protector may be formed within the respective drivers in order to be connected to the respective electrodes or formed at the exterior of the drivers. The energy storage unit and the protector connected to the electrodes will be described with reference to FIGS. 4 and 5.

Figure 4:
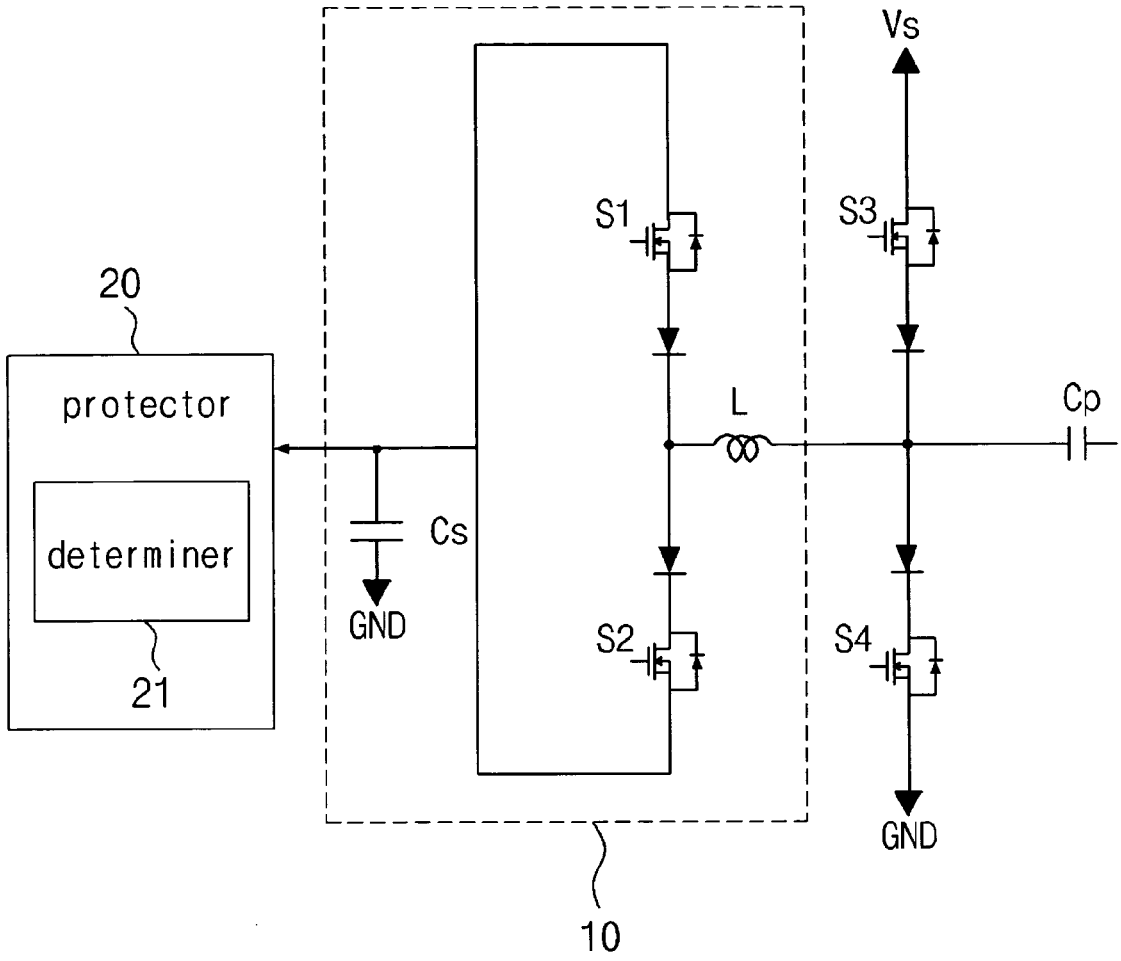
FIG. 4 is a view for explaining an energy storage unit and a protector of the plasma display apparatus according to the embodiment of the present invention.

FIG. 4 is a view for explaining the energy storage unit and protector of the plasma display apparatus according to the embodiment of the present invention.

Referring to FIG. 4, the plasma display apparatus of the invention comprises a plasma display panel Cp, an energy storage unit Cs consisting substantially of a capacitor for storing an energy supplied to at least one of a plurality of electrodes formed in the plasma display panel Cp, and a protector 20 that controls the operation of a driver if the voltage of both ends of the energy storage unit Cs is beyond a predetermined voltage range so that a voltage level of energy stored in the energy storage unit Cs is maintained at the predetermined voltage range. The energy storage unit Cs and the protector 20 of the invention store and control the energy for driving the scan or sustain electrodes to which the sustain voltage Vs is applied among the electrodes formed in the plasma display panel Cp during the sustain period. That is, a driver of FIG. 4 corresponds to the scan driver 320 or the sustain driver 330 shown in FIG. 3

The plasma display apparatus is provided with an energy recovery circuit 10 for recovering energy stored in the plasma display panel Cp and re-using it during the sustain period. The protector 20, as shown in FIG. 4, stops the operation of a driver connected to the energy storage unit Cs if the voltage of both ends of the energy storage unit Cs in which energy recovered through the energy recovery circuit 10 is accumulated is beyond a predetermined reference range.

For this, the protector 20 comprises a determiner 21 for determining whether the voltage applied to both ends of the energy storage unit Cs used for a circuit device, such as a capacitor, is beyond a predetermined voltage range and blocks the operation of a switching device of a driver for supplying and recovering energy from the energy storage unit CS, i.e., of the energy recovery circuit 10 connected to the energy storage unit Cs, according to the result of determination of the determiner 21.

The determiner 21 comprises at least one comparator (not shown) for comparing a voltage level of the energy storage unit Cs with a predetermined voltage. In other words, the determiner 21 senses whether the voltage level of the energy storage unit Cs is higher than a highest reference voltage or less than a lowest reference voltage by using the comparator such as an operational amplifier. Then the determiner 21 outputs a control signal for blocking a driving signal of the energy recovery circuit 10 which stores and recovers the energy in the energy storage unit Cs in order to prevent an overcharge or malfunction of the energy storage unit Cs.

Meanwhile, the determiner 21 further comprises a compensator for previously compensating a noise component of energy supplied thereto. A description will be made of the compensator and the comparator with reference to FIG. 6.

Thus the protector 20 stops the operation of a switch of the energy recovery circuit 10 upon receipt of the control signal from the determiner 21. Preferably, the protector 20 stops the operation of first to fourth switches $S_1$ to $S_4$ operated to store energy in the energy storage unit Cs. As the first to fourth switches $S_1$ to $S_4$ are turned off, the operation of the scan or sustain driver comprising the energy recovery circuit 10 is stopped. Then the energy is not stored any more at both ends of the energy storage unit Cs and the energy stored in the energy storage unit Cs is discharged. Therefore, the voltage level of the energy storage unit Cs is lowered.

If the voltage level of energy stored in the energy storage unit Cs by the protector 20 exceeds the highest reference value, the protector 20 stops the operation of the first to fourth switches $S_1$ to $S_4$, thereby preventing an overcharge of the energy storage unit Cs and obviating explosion of the energy storage unit Cs and damage to the circuit caused from the overcharging.

If the voltage level of energy stored in the energy storage unit Cs is lower than the lowest reference value, the operation of the first to fourth switches $S_1$ to $S_4$ is stopped, thereby preventing the energy storage unit Cs from not recovering the energy properly due to the damage such as a short and reducing energy loss.

At this time, a predetermined voltage range of determining the voltage level of energy stored in the energy storage unit Cs as normal differs according to the characteristics of the plasma display apparatus. It is preferable that the predetermined voltage range is greater than 95% and less than 105% based on a predetermined reference voltage level. As described previously, FIG. 4 illustrates a driver for supplying the sustain voltage Vs and the predetermined reference voltage level is a voltage Vs/2, substantially half the sustain voltage Vs.

That is, since approximately half the sustain voltage Vs is stored in the energy storage unit Cs, if the voltage level of energy stored in the energy storage unit Cs is greater than a half of the sustain voltage Vs by more than 5%, the highest reference value may be set to Vs/2+5% so that it is determined that the energy is overcharged in the energy storage unit Cs. If the voltage level of energy stored in the energy storage unit Cs is less than a half of the sustain voltage Vs by less than 5%, the lowest reference value may be set to Vs/2−5% so that it is determined that the energy storage unit Cs is damaged.

Further, because the plasma display apparatus of the invention is for preventing the energy storage unit Cs from exploding due to the energy overcharged therein, the highest reference value may be set to a voltage for storing 80% of the storage capacitance of the energy storage unit Cs and the lowest reference value to a voltage for storing 20% of the storage capacitance of the energy storage unit Cs. Thus, in the event the energy stored in the energy storage unit Cs is outside the 20% to 80% range of the storage capacitance of the energy storage unit Cs, the operation of the driver may be stopped.

At this time, it should be noted that the highest reference value or lowest reference value for determining that the energy storage unit Cs is in malfunction may differ according to the characteristics of the plasma display panel and of the driver, the individual specifications of each manufacturer or the internal pressure of a device used in the driver.

Figure 5:
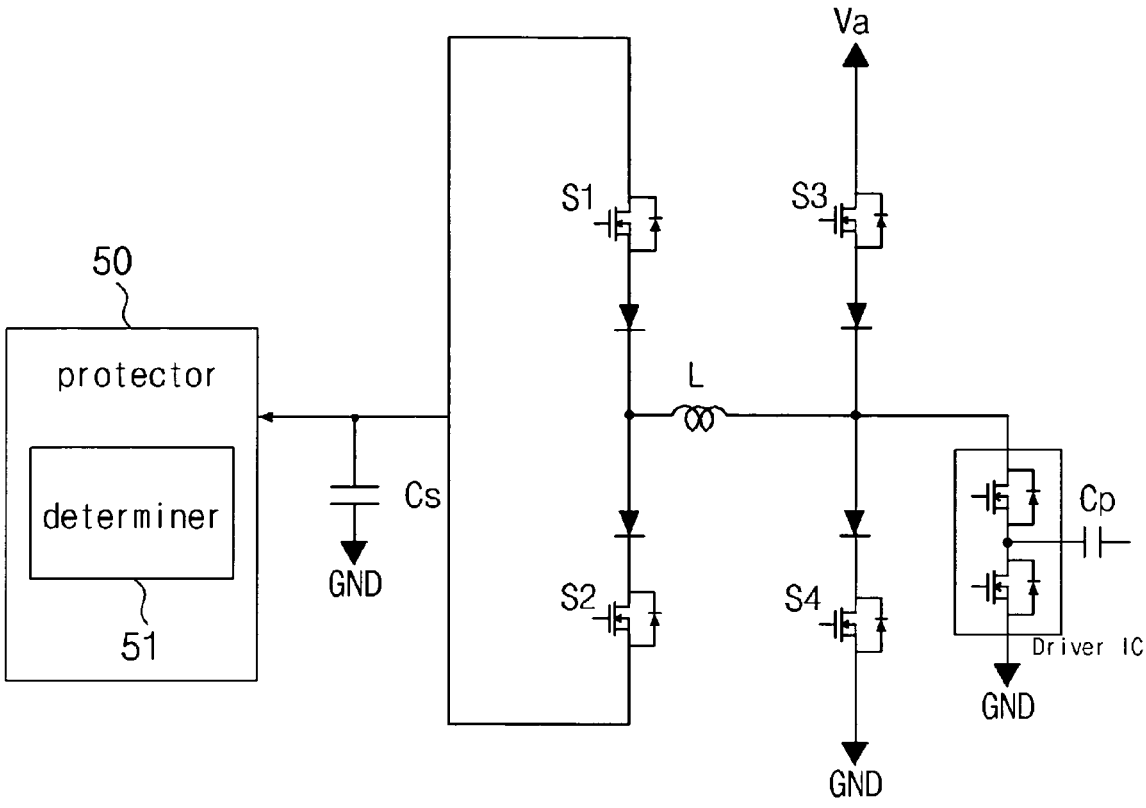
FIG. 5 is a view for explaining another energy storage and protector of the plasma display apparatus according to the embodiment of the present invention.

FIG. 5 is a view for explaining another energy storage and protector of the plasma display apparatus according to the embodiment of the present invention.

Referring to FIG. 5, the plasma display apparatus of the invention comprises a plasma display panel Cp, an energy storage unit Cs consisting substantially of a capacitor for storing energy supplied to at least one of a plurality of address electrodes formed in the plasma display panel Cp, and a protector 20 that controls the operation of a driver if the voltage of both ends of the energy storage unit Cs is beyond a predetermined voltage range so that the voltage level of energy stored in the energy storage unit Cs is maintained at the predetermined voltage range.

The energy storage unit Cs and the protector 50 of the invention store and control the energy for driving the address electrodes to which the address voltage Va is applied among the electrodes formed in the plasma display panel Cp during the address period. That is, a driver of FIG. 4 corresponds to the data driver 3 10 shown in FIG. 3. Thus the plasma display apparatus of the present invention recovers the address voltage Va supplied during the address period and re-uses it, thereby reducing power consumption and stress of the driver. The protector 50 controls the voltage level of energy stored in the energy storage unit Cs.

The protector 50 has characteristics similar to the protector 20 shown in FIG. 4. That is, the protector 50 stops the operation of a driver connected to the energy storage unit Cs if the voltage of both ends of the energy storage unit Cs in which energy recovered through the energy recovery circuit 10 is accumulated is beyond a predetermined reference range. For this, the protector 50 comprises a determiner 51 and blocks the operation of a switching device of a data driver for supplying and recovering energy from the energy storage unit CS, for example, of the energy recovery circuit 10 connected to the energy storage unit Cs, according to the result of determination of the determiner 51. The determiner 51 comprises at least one comparator for comparing a voltage level of the energy storage unit Cs with a predetermined voltage and a compensator for previously compensating a noise component of energy input to the comparator. A description will be made of the compensator and the comparator shown in FIG. 5 with reference to FIG. 6.

If the voltage level of energy stored in the energy storage unit Cs by the protector 50 exceeds the highest reference value, the protector 50 stops the operation of first to fourth switches SI to S4, thereby preventing an overcharge of the energy storage unit Cs and eliminating exposure of the energy storage unit Cs and damage to the circuit caused from the overcharge. If the voltage level of energy stored in the energy storage unit Cs is lower than the lowest reference value, the protector 50 stops the operation of the first to fourth switches $S_1$ to $S_4$, thereby preventing the energy storage unit Cs from not recovering the energy properly due to the damage such as a short and reducing energy loss.

Moreover, a predetermined voltage range of determining the voltage level of energy stored in the energy storage unit Cs as normal can be judged based on a voltage Va/2, half the address voltage Va. If the voltage level of energy stored in the energy storage unit Cs is greater than a half of the address voltage Va by more than 5%, the highest reference value may be set to Vs/2+5% so that it is determined that the energy is overcharged in the energy storage unit Cs. If the voltage level of energy stored in the energy storage unit Cs is less than a half of the address voltage Va by less than 5%, the lowest reference value may be set to Vs/2−5% so that it is determined that the energy storage unit Cs is damaged. Furthermore, it is possible to set the predetermined voltage range to the 20% to 80% range of the storage capacitance of the energy storage unit Cs.

Figure 6:
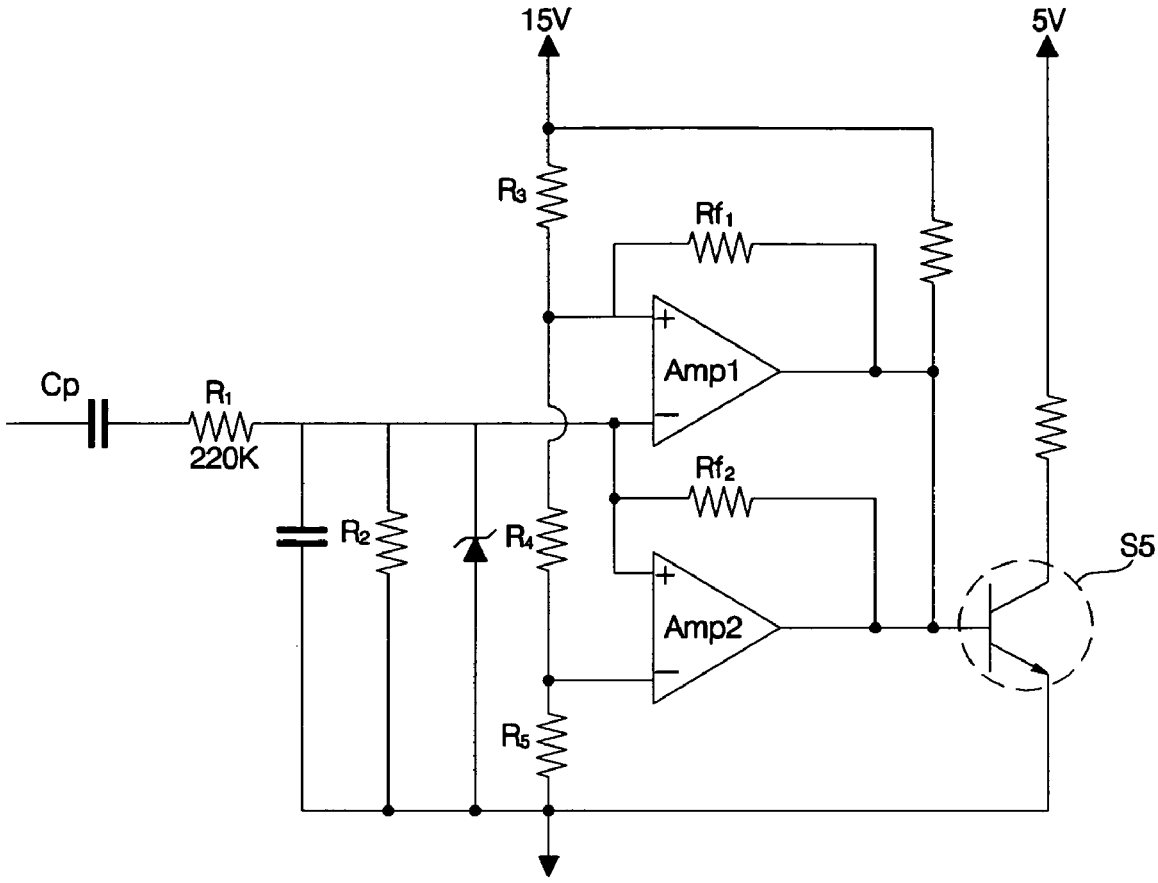
FIG. 6 is a view illustrating a determiner of the plasma display panel apparatus according to the embodiment of the present invention.

FIG. 6 illustrates a construction of the determiners 21 and 51 shown in FIGS. 4 and 5.

The construction of the determiners 21 and 51 shown in FIGS. 4 and 5 according to the embodiment of the invention will now be described with reference to FIG. 6.

Each of the determiners 21 and 51 comprises a plurality of comparators $Amp_1$ to $Amp_2$ for determining whether a voltage applied to both ends of the capacitor Cs is beyond a predetermined reference value. That is, the comparators comprises a first operational amplifier $Amp_1$ for determining whether the voltage of the capacitor Cs is greater than the highest reference value and a second operational amplifier $Amp_2$ for determining whether the voltage of the source capacitor Cs is less than the lowest reference value. In the embodiment of the invention, although the determiner is comprised of the comparators using the operational amplifiers, a variety of determiners may be constructed by using various circuit devices.

A reference voltage serving as the highest reference of a voltage chargeable in the capacitor Cs is applied to the plus (+) terminal of the first operational amplifier $Amp_1$, and a voltage charged in the capacitor Cs is applied to the minus (−) terminal thereof.

At this time, if a voltage of both ends of the capacitor Cs input into the minus (−) terminal is higher than the highest reference voltage applied to the plus (+) terminal, the first operational amplifier Amp, outputs a low signal.

Generally, since a high voltage of more than 170V is used as the sustain voltage Vs, a high voltage of more than 80V is applied as the voltage of energy stored in the capacitor Cs. Thus, a reference voltage applied to the plus (+) terminal has to be increased. However, the circuit operating at a high voltage leads to a reduction in circuit stability, as well as increasing power consumption. Therefore, a plurality of voltage drop resistors $R_1$ to $R_5$ is connected to the input terminals of the comparators $Amp_1$ to $Amp_2$, to thus reduce the voltage input from the capacitor Cs. Accordingly, it is preferred that a high resistance of KΩ is used as the first resistor R1 connected to the capacitor Cs, but the degree of the resistance is not limited thereto.

Moreover, since the voltage level of energy stored in the capacitor Cs is dropped by the first resistor $R_1$, not a high voltage but a low voltage, proportional to the first resistor $R_1$, is used as the highest reference voltage input into the plus (+) terminal.

For example, if a resistor of 220 KΩ is used as the first resistor $R_1$ and the highest reference voltage permitted to the capacitor Cs is set to approximately 150V, a low voltage, 1/10 the reference voltage, may be applied to the plus (+) terminal. In other words, the voltage applied as the highest reference voltage is changeable according to the circuit configuration of the determiner.

Therefore, if the voltage of the capacitor Cs input into the minus (−) terminal of the first operational amplifier $Amp_1$ is higher than the highest reference voltage, the first operational amplifier Amp, outputs a low signal, and if the voltage of the capacitor Cs is lower than the highest reference voltage, the first operational amplifier Amp, outputs a high signal.

On the contrary, in order to determine whether the voltage stored in the capacitor Cs is beyond the lowest reference value, the lowest reference voltage is applied to the minus (−) terminal of the second operational amplifier $Amp_2$ and a voltage charged in the capacitor Cs is applied to the plus (+) terminal thereof.

If the voltage of the capacitor Cs input into the plus (+) terminal of the second operational amplifier $Amp_2$ is lower than the lowest reference voltage, the second operational amplifier $Amp_2$ outputs a low signal, and if a voltage higher than the lowest reference value is charged in the capacitor Cs, the second operational amplifier $Amp_2$ outputs a high signal.

At this time, a plurality of resistors may be connected between the capacitor Cs and the second operational amplifier $Amp_2$ so that the determiner can be driven at a low voltage, and separate terminals for applying a reference voltage to the first and second operational amplifiers $Amp_1$ and $Amp_2$ may be provided so as to compare the voltage stored in the capacitor Cs with the highest and lowest reference voltages. On the other hand, however, the highest and lowest reference voltages applied to the first and second operational amplifiers can be set by adjusting the resistors $R_3$ to $R_5$ as shown in FIG. 6.

The determiner further comprises a switching device $S_5$, such as a PNP type transistor or NPN type transistor, which is conducted if an output signal output from the first and second operational amplifiers $Amp_1$ and $Amp_2$ is high and outputs a high signal of 5V by being short-circuited if the output signal is low When the first or second operational amplifier $Amp_1$ or $Amp_2$ outputs a low signal, this indicates that the capacitor Cs is in malfunction. Thus, the switching device $S_5$ is not conducted if any one of the first and second operational amplifier $Amp_1$ and $Amp_2$ outputs a low signal. The output terminal of a general operational amplifier has an open collector configuration. In the event that the outputs of the first and second operational amplifiers $Amp_1$ and $Amp_2$ are linked together, if the output of one of the comparators becomes low, a low signal is applied to the switching device $S_5$, thereby turning off the switching device $S_5$. In contrast, a high signal is applied to the switching device $S_5$ only when the outputs of both comparators become high, so that the switching device $S_5$ is turned on.

The determiner outputs a control signal with a high value indicating that the voltage level of energy stored in the capacitor Cs is beyond a predetermined voltage range if the switching device $S_5$ is turned off. In contrast, the determiner outputs a control signal with a low value indicating that the voltage level of energy stored in the capacitor Cs is within a predetermined voltage range if the switching device $S_5$ is turned on According to the result of the comparator, at least one driving switching device connected to the capacitor Cs is turned off. That is, if the control signal with a high value is output from the determiner, the switching devices $S_1$ to $S_5$ within the energy recovery circuit are turned off and thus stop the applying of a voltage to the capacitor Cs.

At this time, the control signal with a high value can be applied to all the switches $S_1$ to $S_4$ so that the operation of all the switches $S_1$ to $S_4$ of the energy recovery unit can be stopped, or to the second or third switch $S_2$ or $S_3$ so that only the operation of the second or third switch $S_2$ or $S_3$ can be stopped.

In the determiner thus constructed, while the voltage level of energy stored in the source capacitor Cs is kept within a normal range, if a voltage level applied to the comparators $Amp_1$ to $Amp_2$ is instantaneously increased or decreased due to noise in the circuit, the output of the comparators becomes low and the operation of the energy recovery circuit may be stopped.

However, in order to prevent the operation of the energy recovery circuit from being blocked in the event that the capacitor Cs is normally operated as above but the voltage stored in the capacitor is instantaneously increased or decreased by a peaking noise, the determiner comprises a compensator, for example, a first or second feedback resistor $R_{f1}$ or $R_{f2}$ for previously compensating a noise component of the energy.

When the first or second feedback resistor $R_{f1}$ or $R_{f2}$ is connected to the comparators $Amp_1$ to $Amp_2$, even if the voltage level of energy stored in the capacitor Cs becomes instantaneously higher than the highest value or lower than the lowest value, noise components are compensated by the feedback resistors, thereby keeping the output of the comparators the same.

The first feedback resistor $R_{f1}$ is connected to the first operational amplifier $Amp_1$. In the cased where the voltage level of energy stored in the capacitor Cs is instantaneously increased, voltage compensation occurs to the plus (+) terminal of the first operational amplifier $Amp_1$ to which the highest reference voltage is applied, thereby keeping a high output of the first operational amplifier $Amp_1$.

The second feedback resistor $R_{f2}$ is connected to the second operational amplifier $Amp_2$. If the voltage level of energy stored in the capacitor Cs becomes instantaneously decreased, voltage compensation occurs to the plus (+) terminal of the first operational amplifier $Amp_2$ to which the lowest reference voltage is applied, thereby keeping a high output of the second operational amplifier $Amp_2$.

In this embodiment of the invention, although it has been described the construction in which the feedback resistors $R_{f1}$ to Rf2 are connected to the plus (+) terminals of the comparators $Amp_1$ to $Amp_2$, respectively, the terminals of the comparators connected to the feedback resistors are not limited thereto:but the determiner can be configured by connecting the feedback resistors of the minus (−) terminals of the comparators according to a circuit designer's preference.

Figure 7:
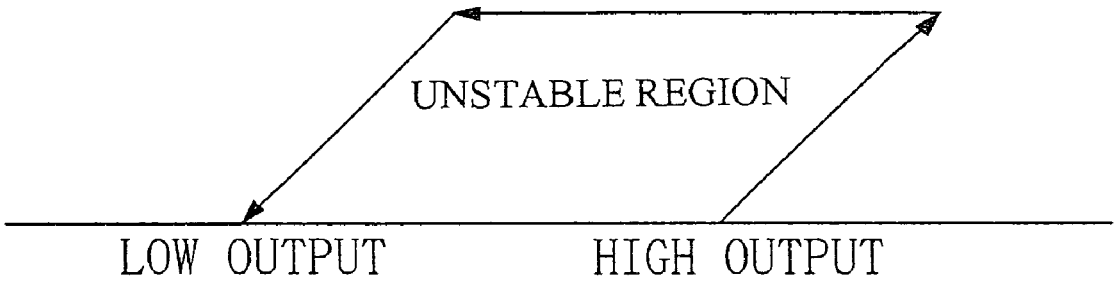
FIG. 7 is a view illustrating a voltage hysteresis characteristic of an energy storage unit according to the embodiment of the present invention.

FIG. 7 is a view illustrating a voltage hysteresis characteristic of the energy storage unit according to the embodiment of the present invention.

As shown in FIG. 7, the determiner shown in FIG. 6 can be configured in such a manner to prevent the output of the determiner from being changed by noise. In this case, an unstable region is a voltage level when the voltage level of energy stored in the capacitor is beyond a predetermined voltage range. A low output is a control signal generated when the determiner determines that the voltage level of the capacitor is within a predetermined voltage range, i.e., a stable region. A high output is a control signal generated when the determiner determines that the voltage level of the capacitor is beyond a predetermined voltage range, i.e., an unstable region. If the voltage level of the capacitor enters the unstable region instantaneously by noise, the feedback resistor has hysteresis characteristics for compensating a high output to a low output in order to prevent the determiner from outputting the high output instantaneously after outputting the low output continuously.

Consequently, the determiner of the invention prevents its control signal from being changed by noise, and reliably determines the voltage level of the capacitor, thereby improving the stability of the driver.

Especially, the protector of the plasma display apparatus can be used for a capacitor provided at a power circuit for applying a sustain voltage Vs or an address voltage Va.

For example, the protector is connected to a plurality of capacitors provided at a scan driver or sustain driver for applying a sustain voltage Va to scan electrodes or sustain electrodes or to a plurality of capacitors provided at a driving board for applying an address voltage Va to address electrodes. If a voltage of both ends of the capacitors is beyond an allowable reference range, the operation of the driving board is stopped. This prevents the plasma display apparatus from being damaged by an overvoltage charged in the capacitors and a high voltage applied to the electrodes, as well as stopping the operation of the driver for applying power in the event charges are not stored in the capacitors but leaked therefrom, thereby stably driving the driver.

As above, the plasma display apparatus can be adapted to every kinds of capacitors provided at a driver.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A plasma display apparatus, comprising:

a plasma display panel in which a plurality of electrodes are formed;

an energy storage unit including a capacitor for storing energy applied to the electrodes; and a protector for maintaining a voltage level of the energy stored in the capacitor of the energy storage unit within a predetermined voltage range and for operating at least one driving switch device through which the energy flows into/from the capacitor, the protector being directly connected to the capacitor via a single electric line.

2. The plasma display apparatus of claim 1, wherein the predetermined voltage range is 95% to 105% of a predetermined reference voltage level.

3. The plasma display apparatus of claim 2, wherein the predetermined reference voltage level is substantially half of a sustain voltage.

4. The plasma display apparatus of claim 2, wherein the reference voltage level is substantially half of an address voltage.

5. The plasma display apparatus of claim 1, wherein the energy stored in the capacitor of the energy storage unit is 20% to 80% of a storage capacitance of the energy storage unit.

6. The plasma display apparatus of claim 1, wherein the protector comprises a determiner for determining whether the voltage level of the energy is outside of the predetermined voltage range and is operative to block an operation of a driver for supplying the energy to or recovering the energy from the energy storage unit according to the determination of the determiner.

7. The plasma display apparatus of claim 6, wherein the determiner comprises at least one comparator for comparing the voltage level of the energy with the predetermined voltage range.

8. The plasma display apparatus of claim 7, wherein the determiner further comprises a compensator for compensating a noise component of energy applied to the comparator.

9. The plasma display apparatus of claim 1, wherein the energy storage unit stores energy for driving a scan electrode or a sustain electrode among the plurality of electrodes.

10. The plasma display apparatus of claim 1, wherein the energy storage unit stores energy for driving an address electrode among the plurality of electrodes.

11. A plasma display apparatus, comprising:

a plasma display panel in which a plurality of electrodes are formed;

a capacitor for storing energy supplied to the electrodes; and a determiner directly connected to the capacitor via a single electric line and operative to compare a voltage level of the capacitor with a predetermined voltage range;

wherein at least one driving switching device through which the energy flows into/from the capacitor is operated according to the comparison of the determiner.

12. The plasma display apparatus of claim 11, wherein the determiner comprises:

a first operational amplifier for comparing the voltage level with a highest value of the predetermined voltage range; and a second operational amplifier for comparing the voltage level with a lowest value of the predetermined voltage range.

13. The plasma display apparatus of claim 12, wherein the first or second operational amplifier is connected to a feedback resistor.

14. The plasma display apparatus of claim 12, wherein the first or second operational amplifier is connected to a voltage drop resistor for decreasing an input voltage.

15. The plasma display apparatus of claim 11, wherein the energy stored in the capacitor is 20% to 80% of a storage capacitance of the capacitor.

16. The plasma display apparatus of claim 11, wherein the capacitor is adapted to apply a sustain voltage to a scan electrode or a sustain electrode among the plurality of electrodes.

17. The plasma display apparatus of claim 11, wherein the capacitor is adapted to apply an address voltage to an address electrode among the plurality of electrodes.

18. A method of driving a plasma display apparatus comprising a plurality of electrodes, comprising the steps of:

determining, by use of a determiner, whether a voltage of an energy in a capacitor for storing energy supplied to the electrodes is maintained within a predetermined voltage range, the determiner being directly connected to the capacitor via a single electric line and at least one switch through which the energy flows into/from the capacitor; and stopping an operation for driving the plurality of electrodes if the voltage of the energy is outside the predetermined voltage range.

19. The method of claim 18, wherein the capacitor is adapted to apply a sustain voltage to a scan electrode or a sustain electrode among the plurality of electrodes.

20. The method of claim 18, wherein the capacitor is adapted to apply an address voltage to an address electrode among the plurality of electrodes.

21. The plasma display apparatus of claim 1, wherein the protector is connected to only one conductor of the capacitor of the energy storage unit via the single electric line and the single electric line has the voltage level of the energy stored in the capacitor of the energy storage unit.

22. The plasma display apparatus of claim 11, wherein the determiner is connected to a conductor of the capacitor via the single electric line having the voltage level of the capacitor.

* * * * *